US006868919B1

(12) United States Patent
Manschitz et al.

(10) Patent No.: US 6,868,919 B1
(45) Date of Patent: Mar. 22, 2005

(54) SWITCHING DEVICE FOR MULTIFUNCTIONAL HAND-HELD MACHINE TOOL

(75) Inventors: Erwin Manschitz, Germering (DE); Peter Hellmann, Obermeitingen (DE)

(73) Assignee: Hilti Aktiengesellschaft, Schaan (LI)

( * ) Notice: Subject to any disclaimer, the term of this patent is extended or adjusted under 35 U.S.C. 154(b) by 512 days.

(21) Appl. No.: 09/653,177

(22) Filed: Aug. 31, 2000

(30) Foreign Application Priority Data

Sep. 3, 1999 (DE) ..... 199 42 156

(51) Int. Cl.[7] ..... E02D 7/02; H01H 9/00
(52) U.S. Cl. ..... 173/47; 173/48; 335/205
(58) Field of Search ..... 335/205–207; 173/29, 47, 48

(56) References Cited

U.S. PATENT DOCUMENTS

| | | | | |
|---|---|---|---|---|
| 2,016,829 A | | 10/1935 | Dederer | |
| 5,842,527 A | * | 12/1998 | Arakawa et al. | 173/48 |
| 5,992,257 A | * | 11/1999 | Nemetz et al. | 74/371 |
| 6,015,017 A | * | 1/2000 | Lauterwald | 173/48 |
| 6,109,364 A | * | 8/2000 | Demuth et al. | 173/48 |
| 6,176,321 B1 | | 1/2001 | Arakawa et al. | |

FOREIGN PATENT DOCUMENTS

| | | |
|---|---|---|
| DE | 4401664 | 7/1995 |
| DE | 19937767 | 2/2001 |
| EP | 775555 | 5/1997 |
| JP | 10261891 | 9/1998 |

* cited by examiner

*Primary Examiner*—Ramon M. Barrera
(74) *Attorney, Agent, or Firm*—Sidley Austin Brown & Wood, LLP

(57) ABSTRACT

The object of the invention is a device, intended for a multifunctional, hand-held tool machine, for example, an electric combination hammer, for the ON/OFF switching or changeover of individual system functions when changing the processing mode, for example, from "hammer drilling" to "chiseling". Pursuant to the invention, the changeover device, which is to be actuated by the user, is coupled with a mechanical driving mechanism, by which a bistable switch, comprising two mutually oppositely movable elements, is actuated. In a combination hammer, the invention guarantees that, when the chiseling operation is selected, certain functions of the system, such as a monitoring of the reaction moment, are interrupted or changed over.

7 Claims, 3 Drawing Sheets

7
1
12
6
4
5

7
1
10
3
6
11
5
4
20
9

SWITCHING DEVICE FOR MULTIFUNCTIONAL HAND-HELD MACHINE TOOL

FIELD OF INVENTION

The invention relates to a device in a multifunctional hand-held tool machine for the ON/OFF or changeover switching of individual electrical functions of a system when the user changes the processing mode by actuating a switching device present on the machine.

BACKGROUND INFORMATION AND PRIOR ART

Multifunctional, hand-held tool machines include, but are not limited to, for example, circular saws, orbital sanders, vibrating grinders, drills or impact drills, as well as combination hammers, which are converted over from a drilling to a chiseling operation. It is understood that the latter type of equipment is an example and is not meant to limit the universal applicability of the invention described herein.

In combination hammers, when the drilling operation is selected, a tool and its holding head are driven to rotate with or without impacting. On the other hand, when the chiseling operation is selected, the tool, that is, the chisel is driven exclusively forwards and backwards to impact. The respective tool is changed over from one type of operation to the other type of operation by rotating a switch mounted at the housing or by shifting a switching key between at least two switching positions. Usually, drilling hammers belong to a class of equipment, which requires a relatively high driving power. In drilling operations, in order to prevent rotation accidents because of blockage of the tool, for example, when it hits iron, due to the reaction moment acting on the housing of the equipment, such tool machines contain means for determining the relative angle of rotation of the housing associated with the driving electronics of the integrated circuit. If the angle of rotation at the housing exceeds a certain value within a short time span of a few milliseconds because the reaction moment has increased suddenly as a result of the blockage of the tool, the drive line between the motor and the tool holder is interrupted by a rapidly acting coupling. Examples of such devices for monitoring the reaction moment are described in detail in the publications WO 88 06 508 A3, DE 43 44 817 C2 or EP 0 686 148 A2 and DE 196 41 618 A1.

If the user selects a different mode of operation, such as the chiseling operation, there is no danger of rotation accidents, since the tool is no longer driven rotationally. The individual electrical system functions must therefore be set differently for the chiseling operation than for the drilling operation. In particular, an unmotivated switching-off of the combination hammer is undesirable since it would unnecessarily slow down the working process. This is particularly true for certain application cases and courses, for which a sudden rotational movement of the tool machine is unavoidable, for example, when dressing the edges and borders of concrete constructions and when breaching walls with a chisel and the like. In other words, when the chiseling operation is selected, the electrical system function of the time-dependent rotation angle monitoring and, if necessary, interruption of the drive line should be switched off and/or individual operating parameters of the tool machine should be switched over.

OBJECT OF THE INVENTION

It is therefore an object of the invention to provide a device for multifunctional hand-held tool machines, by which, when changing a mode of operation, for example, from a drilling to a chiseling operation in a combination hammer, information that ensures that certain electrical system functions are selected in conformity with the operating mode selected, is supplied to the electronics of the machine.

SUMMARY OF THE INVENTION

The objective, is accomplished by claim 1, is based on the idea of changing over the selection of the processing mode, which is done manually by the user moving a mechanical turning knob, a sliding key or the like, into a suitable path displacement and transforming this path displacement by a bistable switch, comprising two mutually movable elements, into digital information, by which the electrical system function, appropriate for the operating mode in question, is selected. This can be accomplished, for example, so that, in a combination hammer, when the chiseling operation is selected, the inquiry routine for the triggering criterion of a magnetic coupling is masked. A different possibility consists of repressing the actual switching signal for the magnetic coupling when the chiseling operation is selected.

BRIEF DESCRIPTION OF THE DRAWINGS

For a more complete understanding of the invention, and the advantages thereof, reference is now made to the following descriptions taken in conjunction with the accompanying drawings, in which.

DETAILED DESCRIPTION

It should be noted that in all the Figures, corresponding components or structural groups have been given the same reference numbers.

Figure 1:
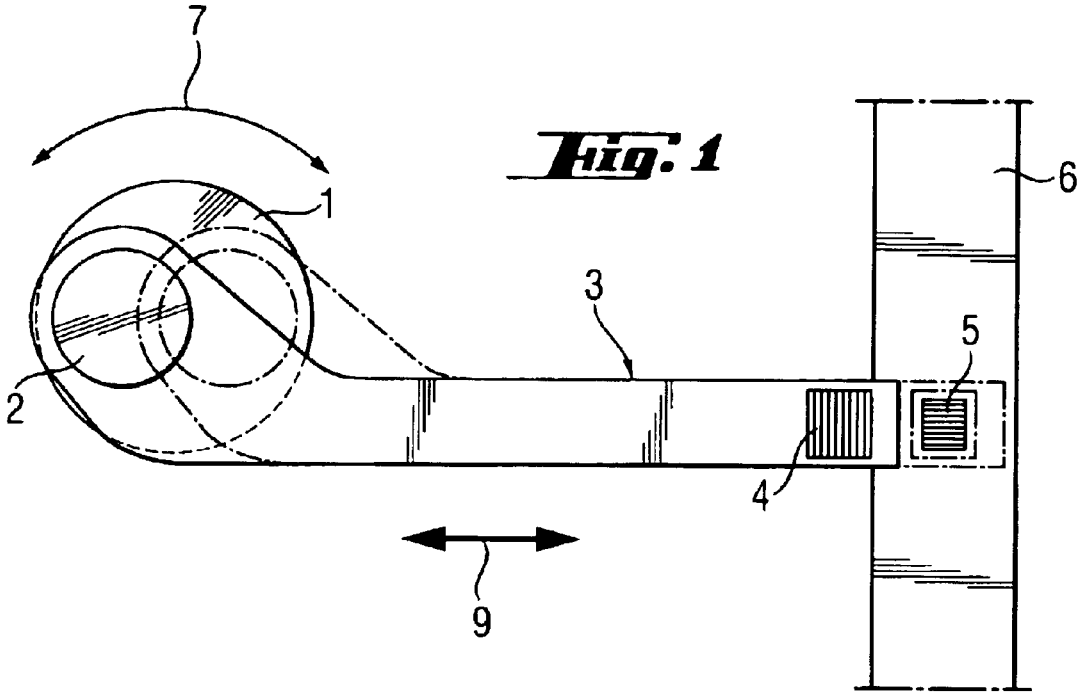
FIG. 1 illustrates a first embodiment of an ON/OFF or changeover device for a multifunctional, hand-held tool machine, in accordance with the invention.

FIG. 1 illustrates a first embodiment of a switching-off or changing-over device of the invention. In the housing (not shown) of an electrical combination hammer, there is a changeover knob 1, which can be adjusted between two positions, which are offset from one another usually by 180°, in the directions of a double arrow 7. In a combination hammer, it is possible to choose between the "chiseling" operating mode and the "hammer drilling" operating mode. The changeover knob 1 is provided on the inside of the tool machine, facing the viewer, with an eccentric crank pin 2. Crank pin 2, is, preferably, integrally molded in one piece and a switch rod 3, which can be shifted back and forth in the form of a connecting rod, is rotatably mounted on pin 2 and, when the "hammer drilling" switching position is selected, is in the position shown by the solid lines. On the other hand, if the user selects the "chiseling" mode of operation, the switch rod 3 is shifted to the right in the direction of arrow 9, as shown by the broken line. The switching rod 3 may be guided in a guide (not shown), which may be integrally molded to the inside of the housing of the machine.

At the front end of the switch rod 3, averted from the crank pin 2, a switching magnet, especially a permanent magnet 4, is fixed. The switching magnet 4 acts together with a sensor-controlled switch, especially a Hall sensor 5, which is tied into control and monitoring electronics 6 of the tool machine (in a manner not shown). In the "hammer drilling" switching position, as shown, the permanent magnet 4 is in a position, remote from the Hall sensor 5. The switch, connected with the Hall sensor 5 is, for example, in the OFF position. If the knob 1 is turned to the "chiseling" position, the switching magnet 4 reaches a region, in which it overlaps with the Hall sensor 5, so that the latter switches over from the OFF (NO) switching position to the ON (YES) switching position.

In the "hammer drilling" switching position, that is, in the OFF switching position of the Hall sensor 5, certain operating parameters of the driving mechanism are selected and, in particular, the reaction moment monitoring becomes effective and ensures that a magnetic coupling (not shown) of the drive line between the driving mechanism and the tool holder is interrupted suddenly, as soon as blockage of the tool, which is dangerous to the user, is detected. On the other hand, in the "chiseling" position of the knob 1, the Hall sensor-activated switch is switched, for example, into the ON position. In this case, the software routine for the reaction moment monitoring is inoperative and/or the actual switching signal for the magnetic coupling is stopped. In other words, when the "chiseling" operating mode is selected, the undesirable switching-off of the combination hammer during a working process is stopped even in the event that, due to the working cycle and/or the substrate, artifact-like sudden rotary movements occur at the machine during the chiseling.

Figure 2:
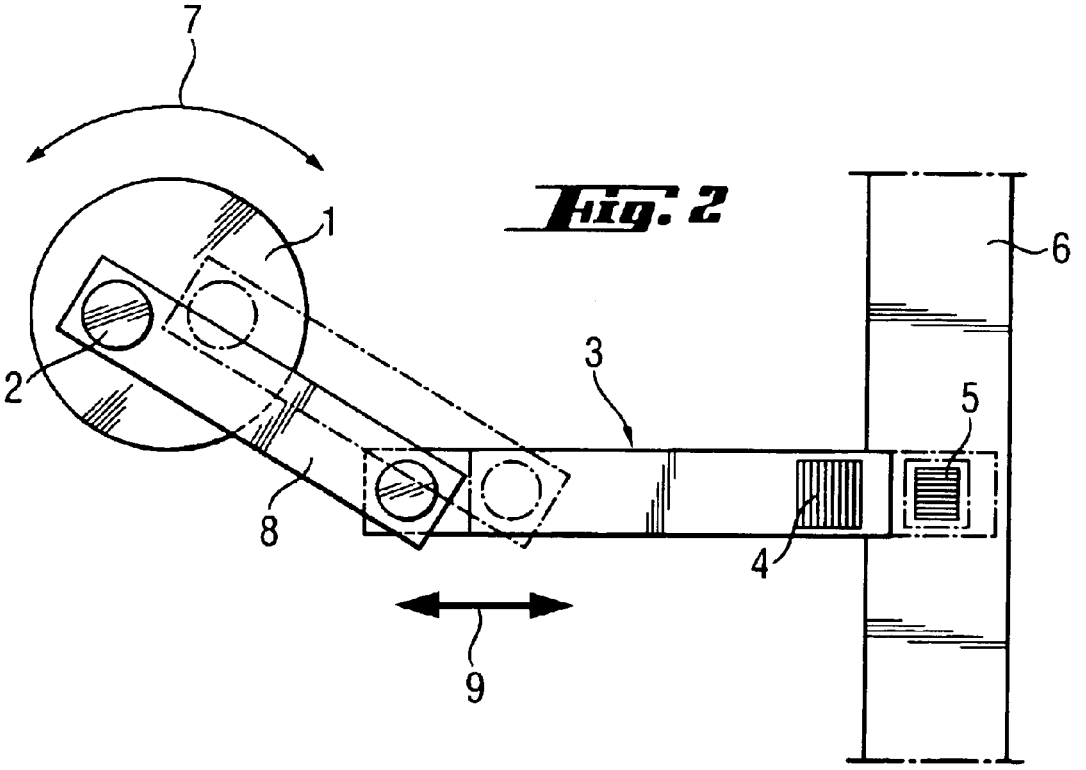
FIG. 2 illustrates a second embodiment of a changeover device of an ON/OFF or changeover device for a multifunctional, hand-held tool machine, in accordance with the invention.

A second embodiment of the invention is illustrated in FIG. 2, wherein there is a different construction of the back and forth crank driving mechanism of the connecting rod 3 from the one illustrated in FIG. 1. Depending on the spatial relationships of the machine, this embodiment of the invention, for which the connecting rod 3 is driven over a crank 8, may be preferred.

Figure 3:
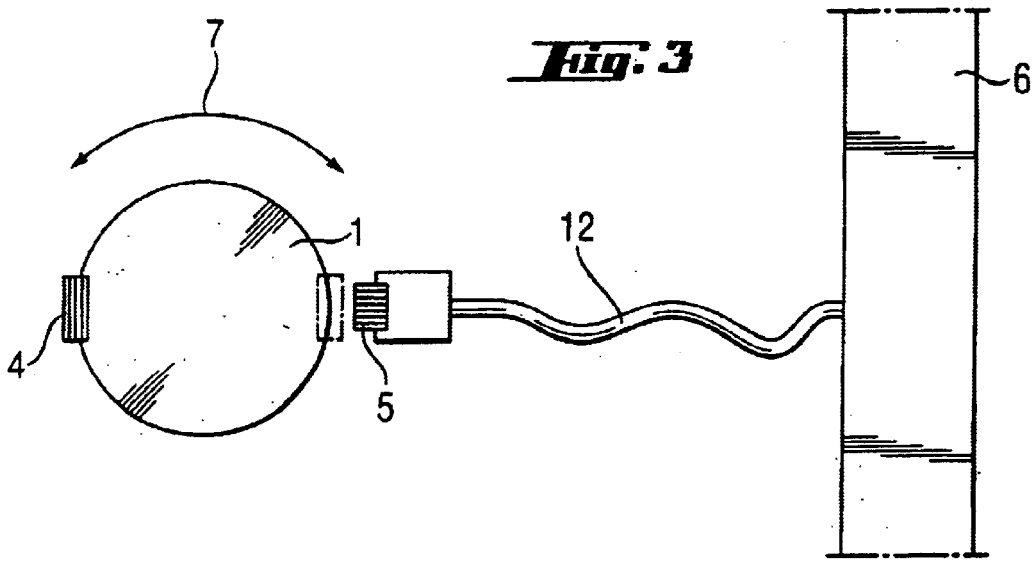
FIG. 3 illustrates a third embodiment of a changeover device of an ON/OFF or changeover device for a multifunctional, hand-held tool machine, in accordance with the invention.

In the third embodiment of the invention, as illustrated in FIG. 3, the permanent magnet 4 is fastened to the interior of the machine directly at the switch 1. The Hall sensor 5 is led over a cable connection 12 out of the driving and monitoring electronics 6 into the immediate vicinity of the knob 1. In the "hammer drilling" position, the permanent magnet 4, again, is remote from the Hall sensor 5; the reaction moment monitoring system is active. If the "chiseling" position is selected, the reaction moment monitoring system is inactive; at the same time, certain other operating parameters are specified.

Figure 4:
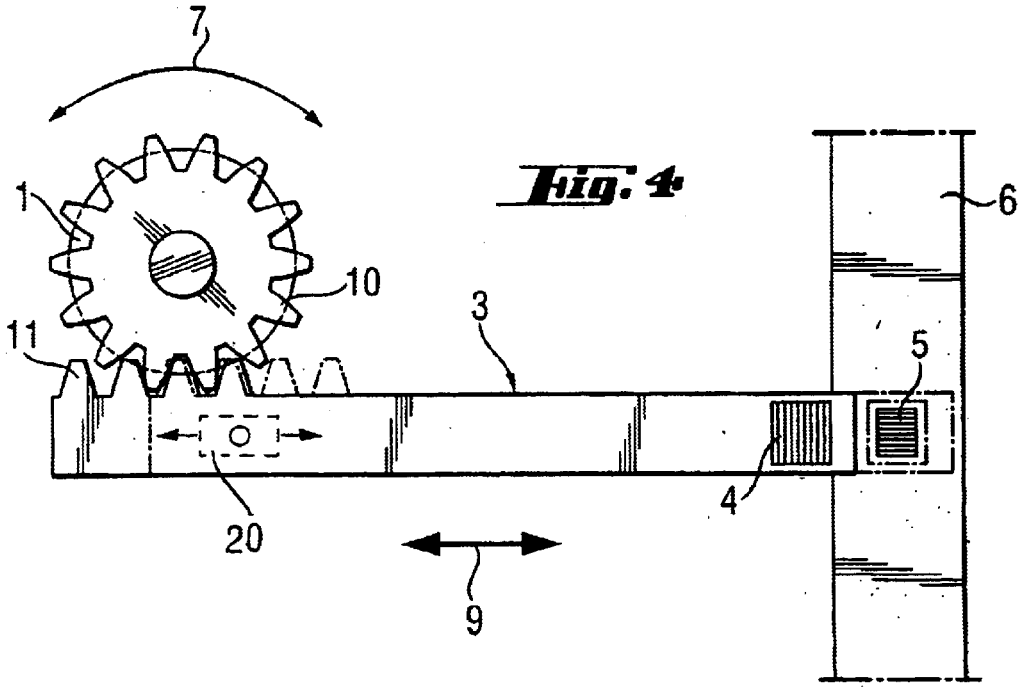
FIG. 4 illustrates a forth embodiment of an ON/OFF or changeover device for a multifunctional, hand-held tool machine, in accordance with the invention.

In the forth embodiment of the invention, as illustrates in FIG. 4, the switch rod 3 has at least at the end, facing the knob 1, a partial denticulation 11, which meshes with a gear wheel 10, which is disposed on the inside of the machine and is seated on the axis of the knob 1. With this driving mechanism for the changeover device, a safe and reliable movement and positioning of the switching magnet 4, in relation to the Hall sensor 5, can be guaranteed.

Figure 5:
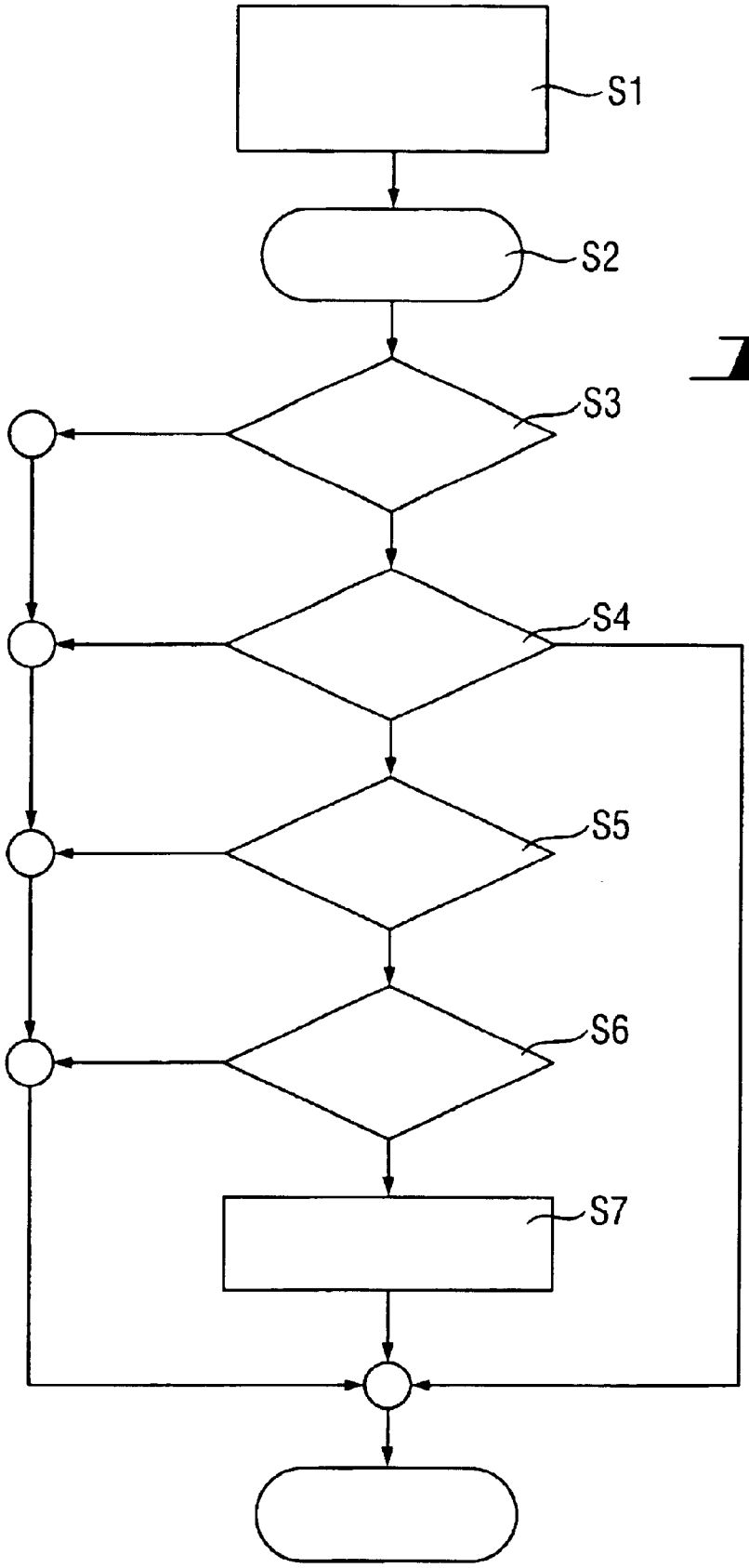
FIG. 5 shows the flow chart of a program sub-routine, in accordance with the invention, for the disconnectable monitoring of the triggering of a release coupling in a combination hammer as a function of critical acceleration values in the event of a blocked tool, determined, for example, by an acceleration measuring device in the housing of the equipment.

FIG. 5, by way of example, illustrates an operating flow chart, in accordance with the invention, for a sub-routine of an algorithm for monitoring critical operating situations, for example, of the above-mentioned dangerous reaction moment when a tool is blocked, in a combination hammer, when the drilling operation is selected or the interruption of the operating sequence of this sub-routine, in the event that the chiseling operation is selected. In step S1, electronically prepared and digitized actual values, which are measured by one or more acceleration sensors disposed in the equipment housing and which containing representative information about the instantaneous acceleration forces acting on the equipment housing, are made available initially, continuously or in very short time intervals. In step S2, the monitoring sub-routine of a control and monitoring algorithm of the machine is started on the basis of at least one instantaneous actual value. In step S3, the instantaneous value is tested to determine whether the instantaneous actual value differs significantly from a previously checked and processed actual value. If the values differ, in step S4, the determination is made whether the motor of the tool machine is switched on. If this is so, it is determined in step S5, for example, after integrating the measured acceleration value twice, whether, within a time interval of a few milliseconds, an angle of twist of the machine housing is to be expected on the basis of the value measured for the acceleration. If this is so, it is subsequently determined, in step S6, whether the user of the equipment has selected the "chiseling" operation or the "drilling" operation. If the machine is set to the "drilling" operation and the measured actual value of the acceleration is correspondingly high, the magnet coupling, which interrupts the drive line from the motor to the tool holder, is opened, in step S7, so that the rotational centrifugal movement of the machine, which results from the sudden increasing reaction moment and is dangerous to the user of the equipment, cannot come about.

In the examples of the invention described so far, the bistable switch element, which can be switched ON and OFF over a connecting rod 3 by the actuating element, that is, for example, the knob 1, was a Hall sensor switch 5, which can be activated by a permanent magnet 4. It is, however, possible and, for many applications with particularly confined space relationships, of advantage to replace the bistable switch elements by a switch, such as an optical-electronic switch, which can be energized by electromagnetic radiation. In such a case, the permanent magnet 4 can be replaced by a very small semiconductor light source which, when the changeover device is actuated, can be shifted relatively to an assigned photoelectric detecting and switching element.

Furthermore, in a modification of the embodiment of FIG. 3, it may be of advantage if the Hall sensor switch 5 is replaced by a permanently installed opto-electronic component. In such a case, the permanent magnet 4 can be replaced by a shadowing element in the form of a platelet or diaphragm element, which protrudes on the inside of the rotary switch 1 and, when the "chiseling" mode of operation is selected, stands in a light path gap between a light source and a photoelectric detection element and, by these means, interrupts the light path between the emitter and detector.

Although the present invention and its advantages have been described in detail, it is understood that various changes, substitutions and alterations can be made herein without departing from the spirit and scope of the invention.

What is claimed is:

1. An electric combination hammer that can be used alternatively as a drilling hammer and a chiseling hammer, wherein, when changing over from a drilling mode to a chiseling mode, an ON/OFF and change-over switching device for individual electrical functions of the combination hammer are actuated at the same time, comprising a bistable switch including two elements (4,5) that can be moved relative to one another by the actuation of the changeover device (2,3), wherein a bistable switch, in one switching position of the changeover device (2,3), switches individual electrical system functions of the machine into the active position and, in a different switching position, switches these functions into an inactive position, the bistable switch is a Hall sensor switch (5) fixed in the machine, and wherein, when the changeover device (2,3) is actuated, the Hall sensor switch (5) is changeable over by a permanent magnet (4), the magnet (4) being movable closer to and further away from the Hall sensor switch (5), at least one of said electrical system functions is a blocking protection, that is in the active position when the drilling mode is selected, and is switched over into the inactive position when the chiseling mode is selected.

2. The electrical combination hammer of claim 1, wherein an actuating element of said changeover switching device comprises a rotatable knob (1), mounted in the machine housing, and carrying an eccentric push/pull rod (2,3) carrying the movable element-(4) of the bistable switch.

3. The electrical combination hammer of claim 1, wherein the changeover device (2,3) has an actuating element that is alternately changeable over by a user and is coupled with a mechanical movement element fixed to the movable element-(4) of the bistable switch.

4. The electrical combination hammer of claim 3, wherein the actuating element is a sliding key and wherein the sliding key is mounted in the machine housing and connected with a push/pull rod, carrying the movable element-(4) of the bistable switch.

5. The device of claim 3, wherein the actuating element is a knob, mounted in the machine housing, provided with a crank pin (2) on the inside of the housing and is part of a crank gear (3,8), actuating a push/pull rod holding the movable element (4) of the bistable switch (4,5).

6. The device of claim 3, wherein the actuating element is a knob, mounted in the machine housing and on the axis of which, on the inside of the housing, an at least partially denticulated wheel (10) is seated, meshing with a toothed rack fixed to the movable element-(4) of the bistable switch (4,5).

7. The device of claim 3, wherein the actuating element is a knob, mounted in the machine housing and on the axis of which, on the inside of the housing, a holding element (1) for the movable element-(4) of the bistable switch, rotatable with the knob, is seated.

* * * * *